US007094107B2

(12) United States Patent
Wu et al.

(10) Patent No.: US 7,094,107 B2
(45) Date of Patent: Aug. 22, 2006

(54) STRUCTURE OF A MEMORY CARD CONNECTOR

(75) Inventors: Kuo-Chuan Wu, Taipei (TW); Tun-Jen Chen, Taipei (TW); Ming-Jen Liu, Taipei (TW)

(73) Assignee: Asour Technology Inc., Taipei (TW)

( * ) Notice: Subject to any disclaimer, the term of this patent is extended or adjusted under 35 U.S.C. 154(b) by 0 days.

(21) Appl. No.: 11/311,321

(22) Filed: Dec. 20, 2005

(65) Prior Publication Data

US 2006/0105634 A1 May 18, 2006

Related U.S. Application Data

(63) Continuation-in-part of application No. 10/989,081, filed on Nov. 15, 2004, now abandoned.

(51) Int. Cl.
*H01R 24/00* (2006.01)

(52) U.S. Cl. ..... 439/630; 439/188

(58) Field of Classification Search ..... 439/59, 439/61, 188, 630, 631, 541.5
See application file for complete search history.

(56) References Cited

U.S. PATENT DOCUMENTS

| | | | | |
|---|---|---|---|---|
| 6,386,920 | B1 * | 5/2002 | Sun | 439/630 |
| 6,540,523 | B1 * | 4/2003 | Kung et al. | 439/64 |
| 6,612,492 | B1 * | 9/2003 | Yen | 235/451 |
| 6,776,653 | B1 * | 8/2004 | Hsiao | 439/541.5 |
| 6,935,898 | B1 * | 8/2005 | Lai | 439/630 |

* cited by examiner

*Primary Examiner*—Thanh-Tam Le
(74) *Attorney, Agent, or Firm*—Leong C. Lei

(57) ABSTRACT

A structure of memory card connector that comprises a first slot, a second slot, and a third slot for inserting many kinds of memory card. Moreover, the above memory card connector further comprises an interface circuit coupling with the memory card(s) inserted into the first slot, the second slot, and the third slot. In accordance with the memory card connector, the second slot and the third slot are set above or below the first slot. Further, the rear end of the memory card connector is provided with a memory card detecting terminal, a grounding terminal and a write-protect terminal for showing the connection condition between the memory card connector and the memory card.

2 Claims, 6 Drawing Sheets

STRUCTURE OF A MEMORY CARD CONNECTOR

CROSS-REFERENCE

This is a continuation-in-part of the patent application Ser. No. 10/989,081, filed Nov. 15, 2004, now abandoned.

BACKGROUND OF THE INVENTION

1. Field of the Invention

The present invention generally relates to a memory card connector, and more particularly to a memory card connector adapted to be connected with various kinds of memory cards.

2. Description of the Prior Art

Different memory cards are made indifferent scales, and need different memory card connectors. For the convenience on using and carrying, memory card connector, a combo socket for many memory cards in different scales, are produced.

In the prior art, a slot is employed in a memory card connector for many different memory cards. In the above-mentioned design, different guiding parts (concave or convex shape) are used to limit the positions of the different memory cards in the slot. Thus, the memory cards are coupled with different terminal sets and connected with an interface circuit. Therefore, the mentioned memory card connector can be applied to different kinds of memory card. Such as the memory card connector disclosed in TW Pat. No. 495110, the above memory card connector can be applied to four kinds of memory cards with a slot. Moreover, the interface circuit of the above memory card connector can be applied by two different memory cards at the same time.

The above memory card connector can be applied to four different memory cards and can be applied to two memory cards at the same time. However, there are more and more different kinds of memory card used today. In summary, in order to satisfy users' necessary, it is desired to develop a memory card connector applied to more kinds of memory card in smaller space and more memory cards can be used in the memory card connector at the same time.

SUMMARY OF THE INVENTION

According to the background description, an objective of the present invention is to provide a memory card connector to provide three memory cards insertion at the same time.

It is another objective of the present invention to provide a memory card connector to provide an interface circuit for memory cards in different scale.

It is still another objective of this present invention to provide a structure of memory card connector to reduce the outside electromagnetic interference with a grounding design therein.

In accordance with the above-mentioned objects, this invention provides a structure of memory card connector. The above memory card connector comprises a first slot, a second slot, and a third slot for inserting a plurality of different memory card. The memory card connector further comprises an interface circuit coupling with the memory cards in the first slot, the second slot, and the third slot. In the above memory card connector, the second slot and the third slot are set side by side and positioned above or bellow the first slot.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

It is noted that the drawings presents herein have been provided to illustrate certain features and aspects of embodiments of the invention. It will be appreciated from the description provided herein that a variety of alternative embodiments and implementations may be realized, consistent with the scope and spirit of the present invention.

It is also noted that the drawings presents herein are not consistent with the same scale. Some scales of some components are not proportional to the scales of other components in order to provide comprehensive descriptions and emphasizes to this present invention.

One preferred embodiment of this invention is a structure of a memory card connector. The mentioned memory card connector comprises a bigger slot for memory cards in larger scale, and two smaller slots set side by side for memory cards in other scale. In the above-mentioned memory card connector, the three slots can be employed for three memory cards in different scales at the same time.

Figure 1:
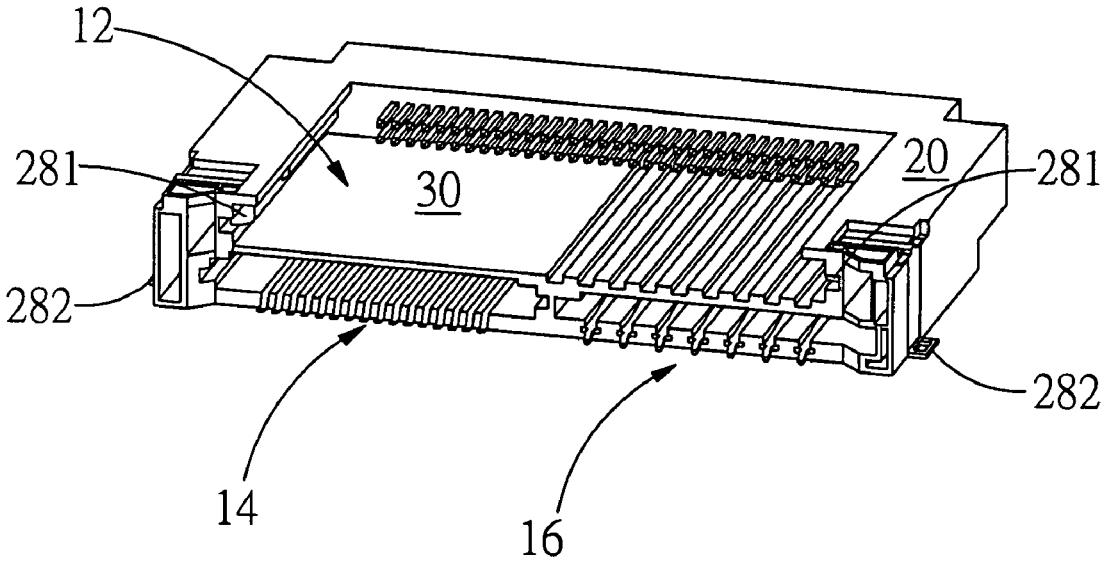
FIG. 1 shows a diagram illustrating a memory card connector according to this invention.

Referring to FIG. 1, the memory card connector according to a preferred embodiment of the present invention mainly comprises a base 20 and a partition 30. The partition 30 has a horizontal part and a vertically downwardly extending part and mounted on the base 20 to provide a first slot 12 above the horizontal part, a second slot 14 under the first slot 12 and a third slot 16 under the first slot 12. The second and third slots 14 and 16 are positioned at opposite sides of the vertically downwardly extending part of the partition 30.

The second slot 14 and the third slot 16 are set side by side and below the first slot 12. The first slot 12 comprises a plurality of first terminal sets each having a plurality of first terminals and adapted to engage with a different type of memory cards one at a time. In another case of this embodiment, the second slot 14 and the third slot 16 are set side by side and bellow the first slot 12. In still another case according to the mentioned embodiment, the positions of the second slot 14 and the third slot 16 can be exchanged.

Figure 3:
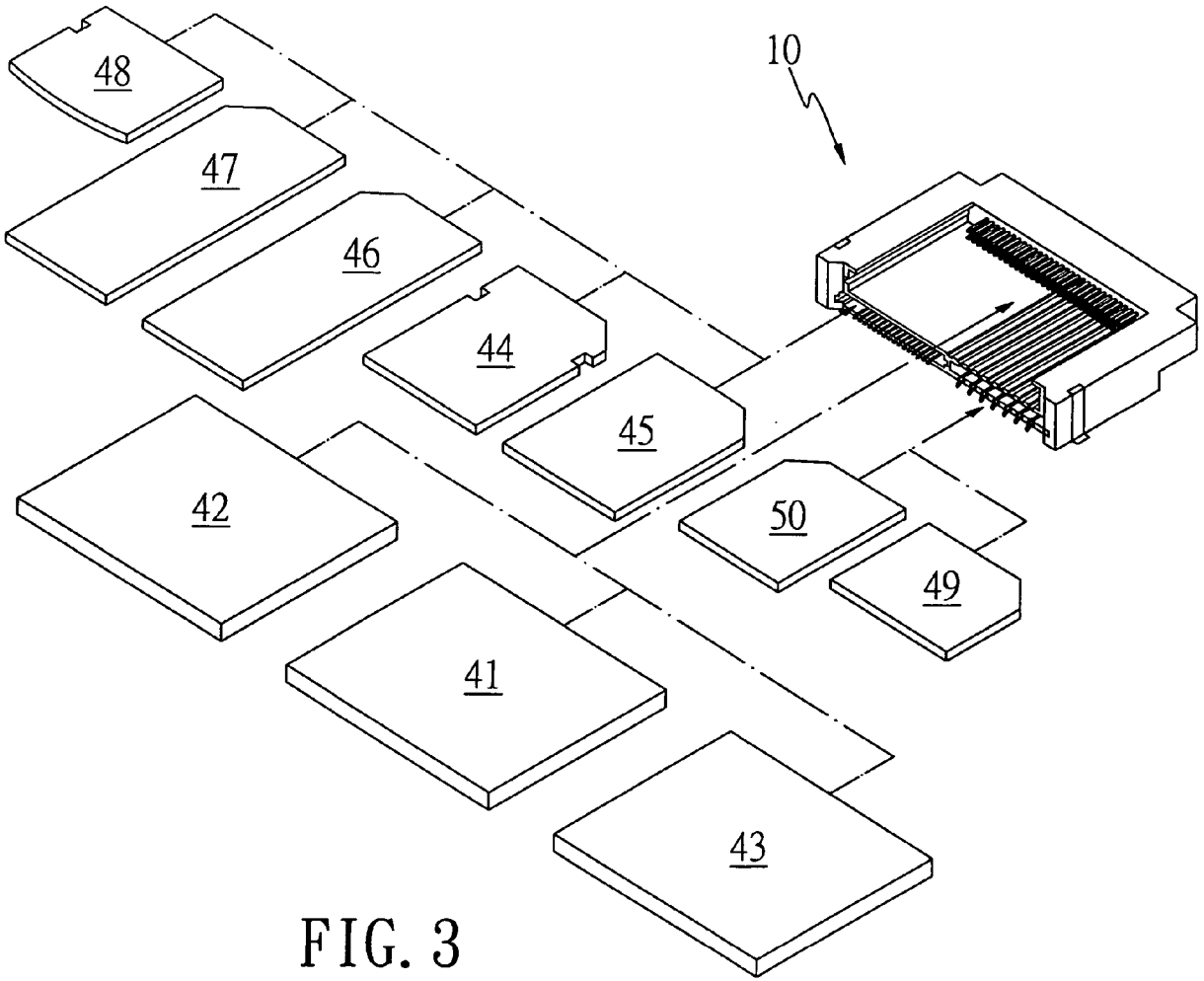
FIG. 3 shows a diagram representing an application in accordance with an embodiment of the present invention.

As illustrated in FIG. 1, the first slot 12 is constructed of the base 20 and the upper part of the partition 30. The first slot 12 comprises a plurality of first terminal set 22. Each first terminal set comprises a plurality of first terminal. When a first memory card is inserted into the first slot 12, the first terminals are employed for coupling the first memory card and an interface circuit, not shown in the figure. The first slot 12 can be applied to many first memory cards in different scales. For example, as shown in FIG. 3, the scales of the first memory card comprise CF (Compact Flash) I 41, CF II 42, and IBM Micro drive 43. When a different kind of the first memory card inserted into the first slot 12, a different first terminal set 22 corresponding to the above first memory card is used to couple the first memory card and the interface circuit.

Figure 2:
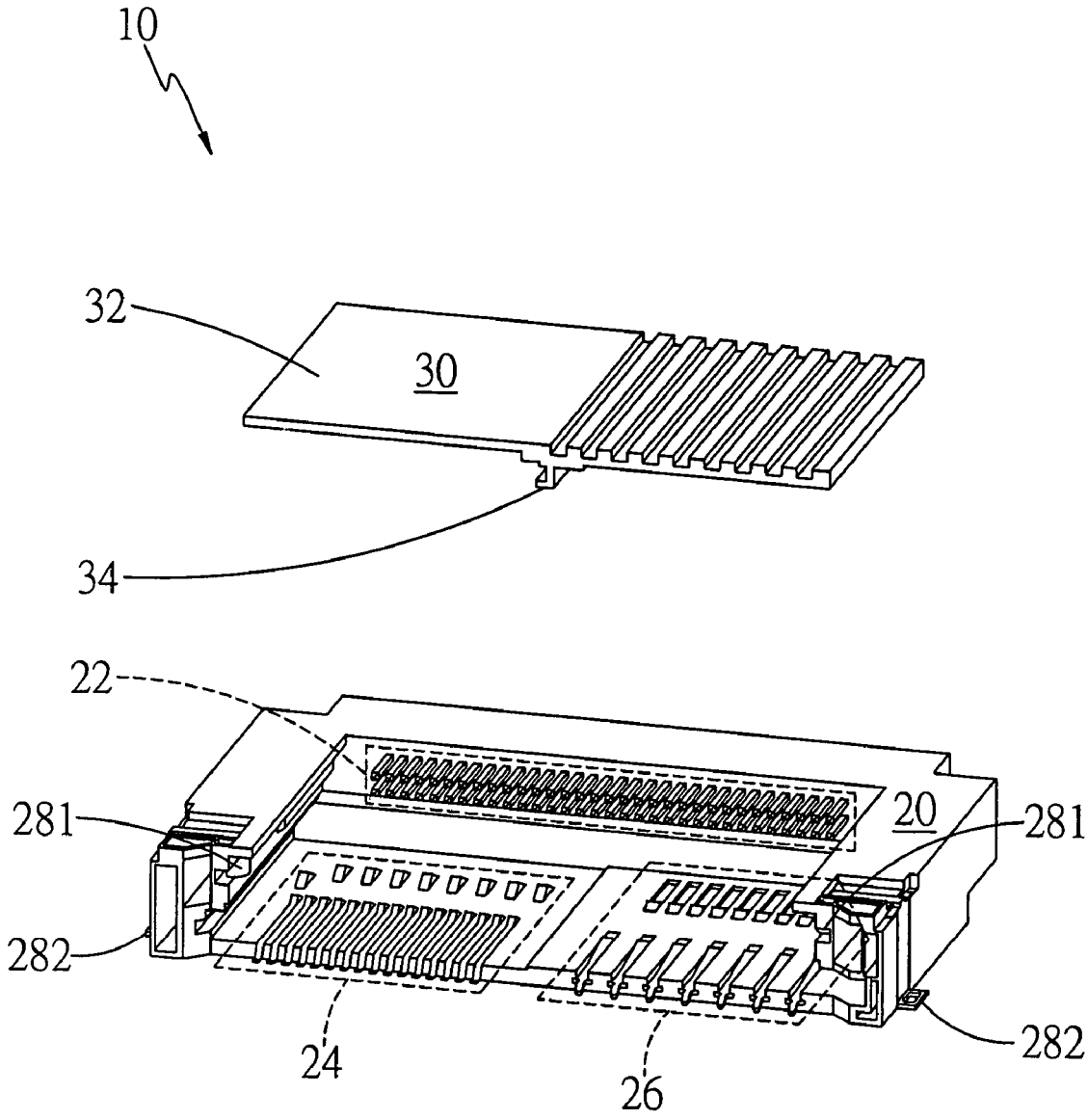
FIG. 2 depicts a diagram illustrating the parts of the memory card connector shown in the FIG. 1.

As shown in FIG. 1, the second slot 14 and the third slot 16 are constructed of the base 20 and the lower part of the partition 30. The partition 30 is made in T shape, as shown in FIG. 2, and is constructed from a horizontal part 32 and a vertical part 34. The first slot 12 is positioned on the horizontal part 32. The second slot 14 and the third slot 16 are under the horizontal part 32, and positioned at opposite sides of the vertical part 34.

The second slot 14 comprises a plurality of second terminal set 24. Each second terminal set comprises a plurality of second terminals. When a second memory card is inserted into the second slot 14, the second terminals are employed for coupling the second memory card and the interface circuit. The second slot 14 can be applied to many second memory cards in different scales. For example, the scales of the second memory card comprises SD (Secure Digital Memory Card) 44, MMC (Multimedia Card) 45, MS (Memory Stick) 46, MS Pro (Memory Stick Pro) 47, and XD (xD Picture Card) 48. Every kind of the second memory card is corresponded to a second terminal set 24. When a second memory card is inserted into the second slot 14, the second terminal set 24 corresponding to the second memory card is used to couple the second memory card with the interface circuit.

The third slot 16 comprises a plurality of third terminal set 26. Every third terminal set comprises a plurality of third terminals. When a third memory card is inserted into the third slot 16, the third terminals are employed for coupling the third memory card and the interface circuit. The third slot 16 is suitable to many third memory cards in different scales. For example, the scales of the third memory card comprises MS DUO 49, RS MMC (Reduced Size multimedia Card) 50, as shown in FIG. 3. Every kind of the third memory card is corresponded to a third terminal set 26. When a third memory card is inserted into the third slot 16, the third terminal set 26 corresponding to the third memory card is used to couple the third memory card with the interface circuit.

In accordance with the above description, the mentioned memory card connector can be applied to at least 10 kinds of memory cards. Moreover, three different kinds of memory cards can be inserted into the memory card connector at the same time, and the three memory cards can be used at the same time by coupling the memory cards with the interface circuit of the memory card connector.

Besides, in the mentioned embodiment, every slot, including the first slot 12, the second slot 14, and the third slot 16, can further comprise guiding part (concave or convex shape) at both sides of the slot for fixing different kinds of memory card. In one preferred example of this embodiment, the guiding part (concave or convex shape) can further comprise a grounding circuit 281, and the base further comprises a grounding part 282 at each side. The grounding circuit 281 is coupled with the grounding part 282. Through coupling the grounding part with an external grounding circuit, such as coupling the grounding parts 282 nearby the second slot 14 as shown in FIG. 2 with an external grounding circuit, the outside electromagnetic interference can be reduced. The grounding circuit 281 comprises an iron piece formed/added on a metal part, a pad/pin, an elastic part, or other resembling design. The shape of the grounding circuit 281 is not limited in this embodiment.

Figure 4:
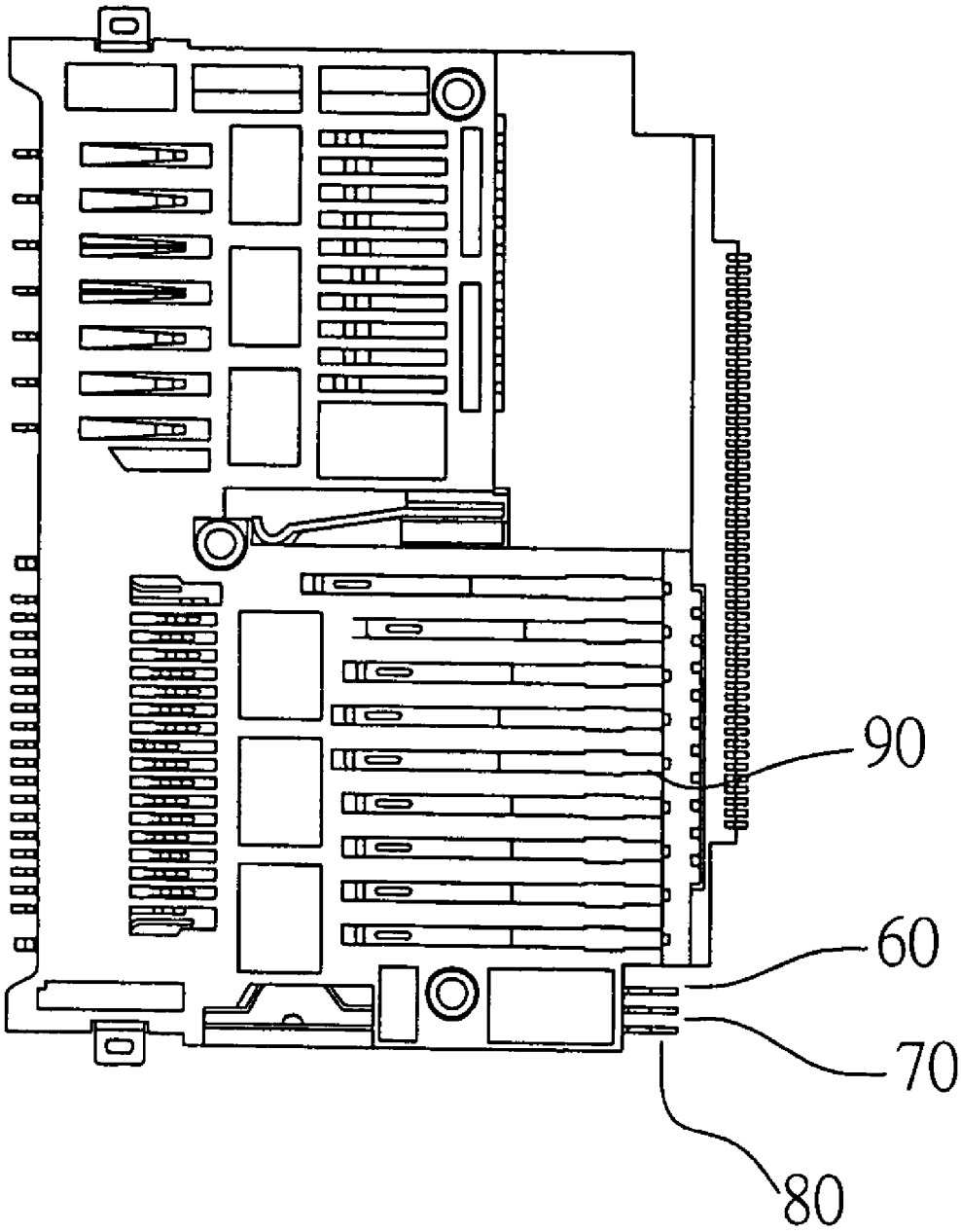
FIG. 4 is a bottom view of the memory card connector.
Figure 5:
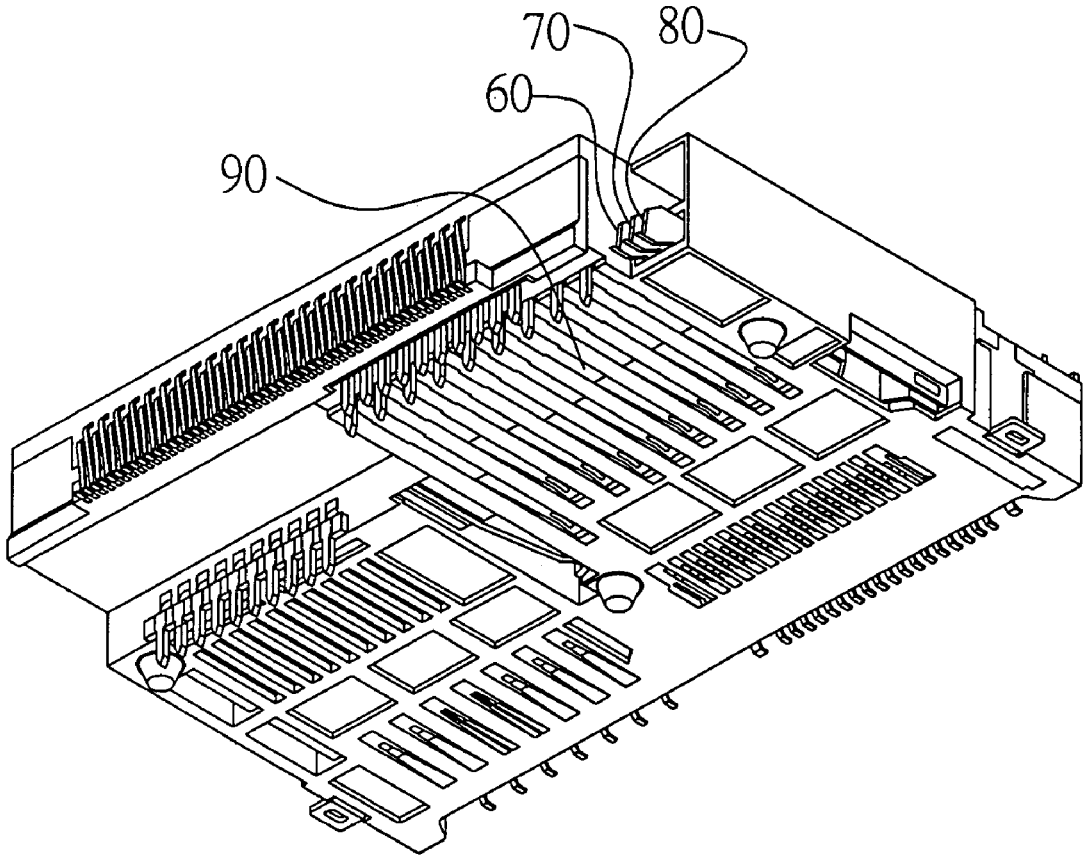
FIG. 5 is a perspective view of the memory card connector.
Figure 6:
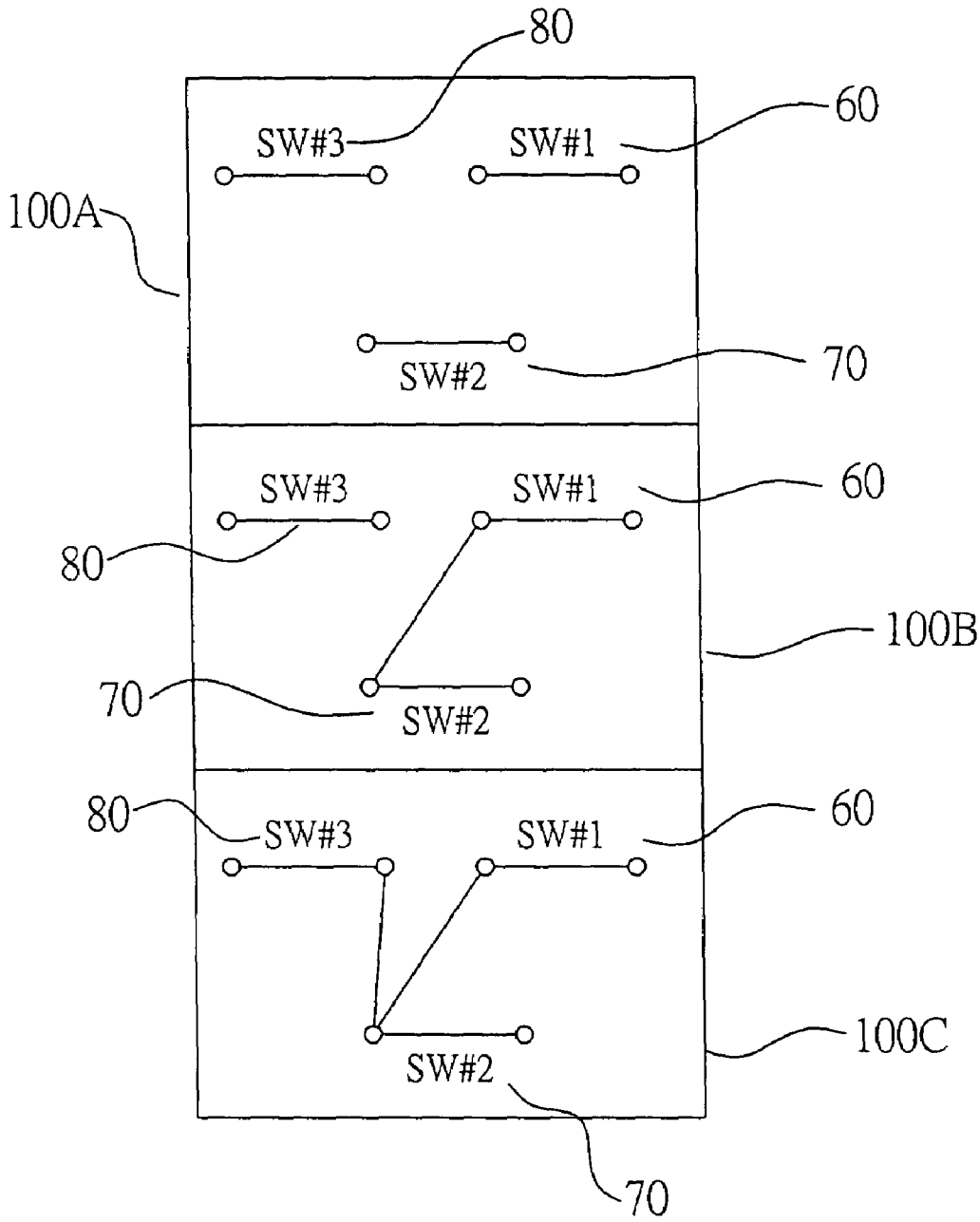
FIG. 6 is a circuit diagram illustrating the working principle of the signal terminals.

Referring to FIGS. 4 and 5, the rear end of the memory card connector is provided with a set of signal terminals which comprises a memory card detecting terminal 60, a grounding terminal 70 and a write-protect terminal 80 for showing the connection condition between the memory card connector and the memory card. FIG. 6 illustrates the working principle of the terminals 60, 70 and 80. As can be seen, when no memory card has been inserted into the memory card connector (condition 100A of FIG. 6), the memory card detecting terminal 60, the grounding terminal 70 and the write-protect terminal 80 are open and do not connect with each other. When a memory card has been detected and the memory card is in write-protect lock mode (see condition 100B of FIG. 6), an end of the memory card detecting terminal 60 will be connected to an end of the grounding terminal 70. Meanwhile, it will be in pull-high mode and connected with a grounding terminal of 3.3 volts. When a memory card has been detected and the memory card is in write-protect unlock mode (see condition 100C of FIG. 6), an end of the memory card detecting terminal 60 will be connected to an end of the grounding terminal 70 which is also connected to an end of the write-protect terminal 80. Meanwhile, it will be in pull low mode and connected with a grounding terminal of zero voltage.

The foregoing description is not intended to be exhaustive or to limit the invention to the precise forms disclosed. Obvious modifications or variations are possible in light of the above teachings. In this regard, the embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the inventions as determined by the appended claims when interpreted in accordance with the breath to which they are fairly and legally entitled.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A structure of memory card connector comprising:

a base having a grounding part and a rear end; and a partition having a horizontal part and a vertically downwardly extending part and mounted on said base to provide a first slot above said horizontal part, a second slot under said first slot and a third slot under said first slot, said second and third slots being positioned at opposite sides of said vertical part, said second slot and said third slot being set side by side and below said first slot, said first slot comprising a plurality of first terminal sets each having a plurality of first terminals and adapted to engage with a different type of memory cards one at a time, said first slot being common to CF (Compact Flash) I, CF II, and IBM Microdrive memory cards, said second slot comprising a plurality of second terminal sets each having a plurality of second terminals adapted to engage a different type of memory cards one at a time, said second slot being common to SD (Secure Digital Memory Card), MMC (Multimedia Card), MS (Memory Stick), MS Pro (Memory Stick Pro), and XD (xD Picture Card) memory cards, said third slot comprising a plurality of third terminal sets each having a plurality of third terminals adapted to engage with a different type of memory cards one at a time, said third slot being common to MS DUO and RS MMC (Reduced Size MultiMedia Card) memory cards, each of said first, second and third slots being each provided with a guiding part at both sides thereof, said guiding part comprising a grounding circuit coupled with said grounding part of said base;

said rear end of said base provided with a set of signal terminals, said signal terminals comprising a memory card detecting terminal, a grounding terminal and a write-protect terminal for showing connection condition between said memory card connector and memory cards, whereby when no memory card has been inserted into said memory card connector, said memory card detecting terminal, said grounding terminal and said write-protect terminal are open and do not connect with each other; when a memory card has been detected and said memory card is in write-protect lock mode, an end of said memory card detecting terminal will be connected to an end of said grounding terminal of a predetermined voltage; when a memory card has been detected and said memory card is in write-protect unlock mode, an end of said memory card detecting terminal will be connected to an end of said grounding terminal of zero voltage which is also connected to an end of said write-protect terminal.

2. The memory card connector as claimed in claim 1, wherein said predetermined voltage is 3.3 volts.

* * * * *